United States Patent [19]

Matzagg et al.

[11] Patent Number: 4,742,757

[45] Date of Patent: May 10, 1988

[54] LOCKING DEVICE FOR A GUN BARREL OF AN AUTOMATIC WEAPON

[75] Inventors: Erich Matzagg, Oberndorf-Beffendorf; Gerhard Bilger, Lauterbach; Helmut Mäder, Schramberg, all of Fed. Rep. of Germany

[73] Assignee: Mauser-Werke Oberndorf GmbH, Fed. Rep. of Germany

[21] Appl. No.: 930,809

[22] Filed: Nov. 13, 1986

[30] Foreign Application Priority Data

Nov. 22, 1985 [DE] Fed. Rep. of Germany ..... 3541312

[51] Int. Cl.[4] ..... F41D 11/00

[52] U.S. Cl. ..... 89/154; 89/190; 42/75.02

[58] Field of Search ..... 42/75.02; 89/1.812, 89/27.12, 154, 190

[56] References Cited

U.S. PATENT DOCUMENTS 2,981,154 4/1961 Sweeney ..... 42/75.02

4,388,773 6/1983 Beretta ..... 42/75.02

*Primary Examiner*—Stephen C. Bentley

*Attorney, Agent, or Firm*—McGlew and Tuttle

[57] ABSTRACT

The safety lock for a barrel of automatic weapons comprises a breechblock carrier whose face facing the barrel confronts a slide. This slide is movable essentially perpendicular to the longitudinal axis of the barrel into a recess provided in the outside surface of the barrel, if the barrel is correctly locked.

5 Claims, 1 Drawing Sheet

LOCKING DEVICE FOR A GUN BARREL OF AN AUTOMATIC WEAPON

FIELD AND BACKGROUND OF THE INVENTION

The invention relates in general to firearms and in particular to a new and useful locking device for a gun barrel of an automatic weapon, in particular of machine guns, with a locking device such as a breechblock carrier which is form-closingly connected to the breechblock which in turn communicates with the firing pin of the weapon.

Weapons, in particular machine guns, of the above kind are generally known per se.

There is always the danger in such automatic weapons with exchangeable barrels that when a barrel is exchanged it is not locked, or is only partly locked. When the weapon is subsequently fired, the powder gases will push the not, or only partly, locked barrel out of the weapon and can thereby destroy the entire weapon.

SUMMARY OF THE INVENTION

The invention provides a safety lock for a barrel of automatic weapons which prevents automatically, and in a purely mechanical way, that a shot can be triggered when the barrel is not completely locked.

According to the invention, the face of the locking device, e.g. a breechblock carrier, facing the barrel confronts a slide latch which is movable essentially perpendicularly to the longitudinal axis of the weapon into a recess in the outside surface of the barrel, if the barrel is correctly locked.

In a particularly advantageous embodiment, there may be provided on the breechblock carrier face facing the barrel a recess in the housing of the weapon, which recess is at a suitable, in particular an acute, angle to the longitudinal axis of the barrel so that the slide, when being moved from its outer position into the locked position, travels at the same time along a predetermined path towards the mouth of the barrel. The recess may be of essentially parallelogranular section, the two sides of which mutually opposite in a longitudinal barrel direction being inclined at a suitable, in particular acute, angle to the longitudinal axis of the barrel.

In further development of the invention, the slide may have at its base a projection corresponding in shape and size to the recess in the barrel. In this connection, the slide may communicate in the lower, locked position with an electrical contact for the control of the weapon function.

These features according to the invention offer a safety lock for a barrel of automatic weapons which assures with few and simple technical means perfect functioning at all times. When the barrel is installed in the housing of the weapon and correctly locked, a slide will engage a matching recess in the barrel. It is in this position that the breech can attain its frontmost postion and ignite a cartridge fed in. On the other hand, if the barrel is not completely locked, the safety slide cannot drop into the barrel recess provided for it. Due to its special shape, the safety slide prevents the breechblock from reaching its frontmost position, namely the firing position. Of course, the safety slide may also be used for the control of the weapon function by electrical scanning. If the safety slide and the barrel recess are of appropriate shape, the slide can also assume the function of locking the barrel in a firing position.

The safety lock according to the invention acts automatically and independent of the breech position at every unlocking operation and while the barrel is being removed.

Accordingly it is an object of the invention to provide a safety lock for a barrel of an automatic weapon, particularly a machine gun which has a housing with a breech block carrier therein which is engaged with a breechblock carrier which in turn communictes with a striker pin of the weapon to fire the weapon and which comprises a breechblock carrier which has a face facing the barrel and the barrel has a recess defined in its outer surface and which includes a slide which is movable in the housing substantially perpendicular to the longitudinal axis of the barrel and is engageable with the breechblock carrier and is movable therewith into a recess divided on the outside surface of the barrel, so that when the barrel is correctly locked into position in which the recess engages in the barrel the slide blocks the movement of the breechblock carrier.

A further object of the invention is to provide an automatic weapon safety device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 3:
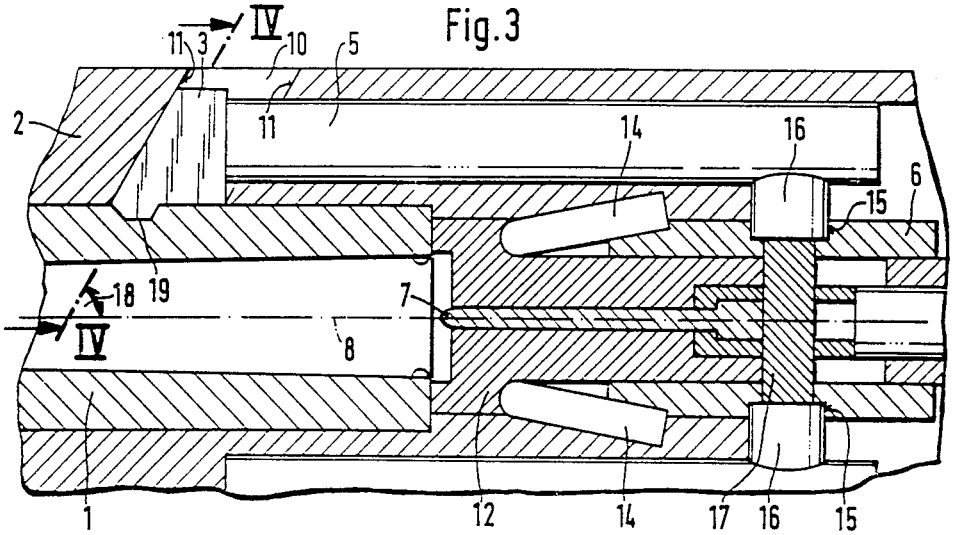
FIG. 3 is a longitudinal sectional view of the safety lock according to the invention when the barrel is properly locked.

Referring to the drawings in particular the invention embodied therein, comprises an automatic weapon which includes a barrel mounted in a housing 2 and a breechblock carrier 5 is movable in the housing and has a face facing the barrel with confronts a slide 3. In accordance with the invention, the slide 3 is movable substantially perpendicular to the longitudinal axis of the barrel into a recess provided in the surface of the barrel if the barrel is correctly locked in position in respect to the weapon.

The automatic weapon comprises a weapon housing 2 in which a barrel 1 is installed and locked. A breeckblock 12 with a central, longitudinal bore 13 in which the striker pin 7 is movably guided is disposed coaxial to the barrel. The front of a locking slide 6 in the breechblock 12 communicates with the support flaps 14 and has profiled recesses 15 form-closingly engaged by a projection 16 of the breechblock carrier 5. A key 17, also connected to the locking slide 6, is connected to or engageable with the striker pin 7 and initiates the lengthwise motion of he striker pin 7 via the lengthwise motion of the locking slide 6 with the breechblock carrier 5.

Figure 1:
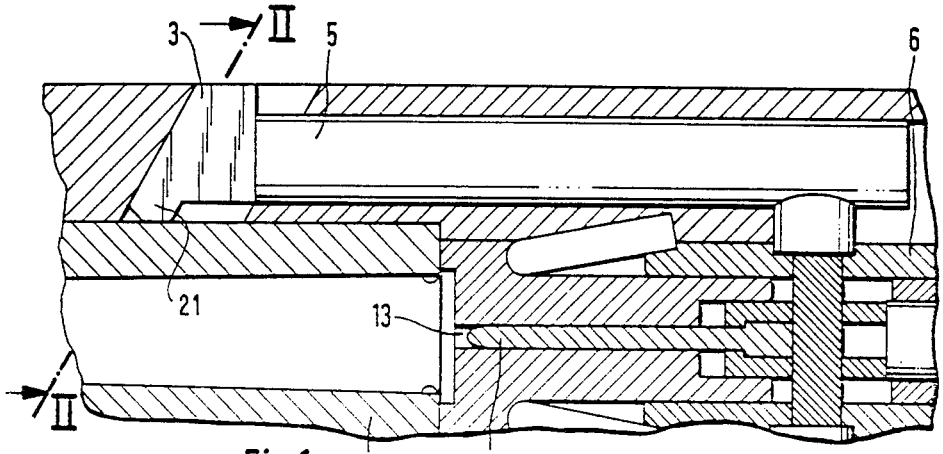
FIG. 1 is a longitudinal sectional view of a safety lock for a barrel of an automatic weapon with unlocked barrel constructed in accordance with the invention.
Figure 4:
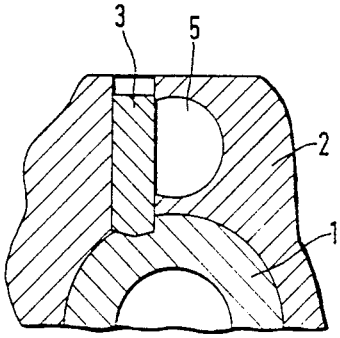
FIG. 4 is a transverse sectional view of the safety lock taken along the line IV—IV in FIG. 3.
Figure 2:
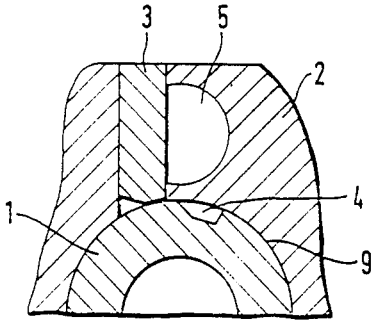
FIG. 2 is a transverse sectional view of the safety lock taken along the line II—II in FIG. 1.

In the weapon housing 2 is a recess 10 which goes through from the outside to the barrel 1 and is essentially a parrallelogram in section whose mutually opposite sides 11 in longitudinal direction of the barrel 1 are inclined at a suitable, preferably acute angle to the longitudinal axis 8 of the barrel. The breechblock carrier 5, movable essentially axis-parallel to the barrel, projects laterally into the recess 10. A safety slide 3 is inserted into the recess 10 and is movable in the recess at an acute angle 18 from the weapon housing 2 towards the barrel 1. At its base, the safety slide 3 has a projection 21 which engages form-closingly a corresponding recess 4 in the barrel whenever the barrel is correctly locked. It is in this position that the breechblock carrier 5, which communictes with the locking slide 6 and the striker pin 7, can attain its frontmost position, namely the firing position and thereby ignite a cartridge fed in. On the other hand, if the barrel is not or only partly locked according to FIGS. 1 and 2, the safety slide 3 cannot drop into the recess 4 of the barrel 1 provided for it. Due to its shape, the safety slide 3 prevents the breechblock carrier 5 in this position from reaching the firing position. In other words, the striker pin 7 is mechanically blocked on its way by the breechblock carrier 5 and the safety slide 3.

Additionally, the safety slide 3 may communicate in its locked, lower position with an electrical contact not shown for the control of the weapon function.

If the safety slide 3 and the recess 4 in the barrel 1 are of appropriate shape, the safety slide can also assume the function of locking the barrel in a firing position.

All details shown in the figures and explained in the specification are important for the invention.

While a specific embodiment of the invention has been shown and described in detail to illustrate the application of the principles of the invention, it will be understood that the invention may be embodied otherwise without departing from such principles.

What is claimed is:

1. A safety lock for a barrel of a machine gun, comprising: a housing, a breechblock carrier in said housing which is slidably movable therewith during the firing of the weapon, a breechblock slidably movable in said housing with said breechblock carrier; a striker pin associated with said breechblock and movable thereby; a barrel for receiving cartridge, said breechblock having a face opposite said barrel, said barrel having a recess defined in the barrel outer surface; and, a slide movable generally radially in respect to said barrel, said slide having a portion engageable with said recess, said slide being movable into a position to block the movement of said breechblock carrier when said slide is not engaged in the barrel recess, the recess being provided on the surface of the barrel at a position so that when the barrel is correctly locked, the recess, associated with the barrel, is positioned so that it may be engaged by said slide.

2. A safety lock according to claim 1, wherein said housing includes a slot extending at an angle to the longitudinal axis of the barrel in which said slide is movable toward and away from the barrel.

3. A safety lock according to claim 2, wherein the recess is a parallelogram in section having opposite inclined sides extending at an acute angle to the longitudinal axis of said barrel.

4. A safety lock according to claim 2, wherein said slide has a base with a profile projection which engages into the recess of said barrel.

5. A safety lock for a barrel of an automatic weapon, such as a machine gun, comprising: a housing; breechblock carrier in said housing which is slidably movable during the firing of the weapon; a breechblock slidably movable in said housing with said breechblock carrier; a striker pin associated with said breechblock and movable thereby, a barrel adapted to receive a cartridge, said breechblock having a face opposite said barrel, said barrel having a recess defined in the barrel outer surface; and, a slide movable generally radially in respect to said barrel so as to be movable toward and away from said barrel to block the movement of said breechblock carrier when said slide is not engaged in the barrel recess.

* * * * *